US005269578A

United States Patent [19]

Fandrey

[11] Patent Number: 5,269,578

[45] Date of Patent: Dec. 14, 1993

[54] ADJUSTABLE SLING APPARATUS

[75] Inventor: Ronald R. Fandrey, Downers Grove, Ill.

[73] Assignees: Samco Corporation; Suel Asset Management Co., Bedford Park, Ill.

[21] Appl. No.: 746,073

[22] Filed: Aug. 9, 1991

Related U.S. Application Data

[63] Continuation-in-part of Ser. No. 665,688, Mar. 7, 1991, abandoned.

[51] Int. Cl.[5] ..... B66C 1/10

[52] U.S. Cl. ..... 294/74; 294/75; 24/68 CD

[58] Field of Search ..... 294/74, 75, 82.11; 24/136 R, 136 K, 265 BC, 68 CD

[56] References Cited

U.S. PATENT DOCUMENTS

| | | | |
|---|---|---|---|
| 1,181,000 | 4/1916 | Gregg | 294/75 |
| 3,423,799 | 1/1967 | Higuchi . | |
| 3,641,630 | 2/1972 | Farley | 24/68 CD |
| 3,887,966 | 6/1975 | Gley . | |
| 4,395,796 | 8/1983 | Akaura et al. . | |
| 4,451,956 | 6/1984 | Kawahara . | |
| 4,464,811 | 8/1984 | Holmes . | |
| 4,493,135 | 1/1985 | Crook, Jr. . | |
| 4,507,829 | 4/1985 | Looker . | |
| 4,525,007 | 6/1985 | Hsiang | 294/74 X |
| 4,527,309 | 7/1985 | Kawahara | 24/68 CD |
| 4,584,741 | 4/1986 | Kawahara et al. . | |
| 4,751,770 | 6/1988 | Kawahara . | |
| 4,799,296 | 1/1989 | Rasmussen | 294/74 X |
| 4,826,228 | 5/1989 | Dinitz et al. . | |
| 4,915,434 | 4/1990 | Dolezych et al. | 294/74 |

FOREIGN PATENT DOCUMENTS

| | | | |
|---|---|---|---|
| 3722070 | 11/1988 | Fed. Rep. of Germany | 294/74 |
| 3717711 | 12/1988 | Fed. Rep. of Germany | 294/74 |
| 206064 | 10/1968 | U.S.S.R. | 294/74 |
| 461884 | 4/1975 | U.S.S.R. | 294/74 |
| 965943 | 10/1982 | U.S.S.R. | 294/74 |

*Primary Examiner*—Dennis H. Pedder
*Assistant Examiner*—Joseph D. Pape

[57] ABSTRACT

An adjustable sling apparatus is provided which allows one strap to be adjusted to a particular length so that loads of various sizes can be used in conjunction with the sling. A simple and efficient design fixes the length of the strap at the adjusted position. This is accomplished by either rotating a pin over a stationary pin or wrapping the strap in a predetermined fashion around two fixedly mounted, stationary rods.

14 Claims, 6 Drawing Sheets

ADJUSTABLE SLING APPARATUS

BACKGROUND OF THE INVENTION

This is a continuation-in-part of application Ser. No. 07/665,688 filed Mar. 7, 1991 now abandoned whose disclosure is incorporated herein by reference.

FIELD OF THE INVENTION

The present invention is generally directed to a sling apparatus, and more particularly, to an adjustable sling apparatus which can be used to carry loads of varying size by adjusting the length of the carrying strap.

DESCRIPTION OF THE PRIOR ART

Slings are used to lift and transport loads of varying size and shape from one place to another. In the construction industry, dedicated straps are used as slings to transport materials to a construction site. To accommodate a load, the strap must be the proper length. If the load size changes, the strap must then be replaced with a new strap since the strap length is nonadjustable. The lack of adjustability renders the sling inconvenient, burdensome and expensive to use since a supply of various length straps must be kept in stock.

A wide variety of devices employ the principle of rotating one pin over another to create tension in a strap. Many of these devices are used as tie down strap buckles. For example, U.S. Pat. No. 4,507,829 (Looker) discloses a buckle used to tie down cargo on a platform. A handle member is pivotally joined to a body member by a journal pin. A strap is wrapped around the journal pin. When the handle is rotated from a relaxed position to a tension position, a load pin rotates to an opposite side of the journal pin taking the slack out of the strap and placing the strap under great pressure. The following patents also employ the principle of rotating one pin over another to create tension: U.S. Pat. No. 4,751,770 (Kawahara); U.S. Pat. No. 4,584,741 (Kawahara, et al.); U.S. Pat. No. 4,527,309 (Kawahara); U.S. Pat. No. 4,451,956 (Kawahara); U.S. Pat. No. 4,464,811 (Holmes); U.S. Pat. No. 4,395,796 (Akaura, et al.); U.S. Pat. No. 3,641,630 (Farley); and U.S. Pat. No. 3,423,799 (Higuchi).

U.S. Pat. No. 4,493,135 (Crook, Jr.) discloses an adjustable sling with a strap positioned around two pins. The pins, however, are not rotated to wrap the strap around the two pins. The length of the sling is adjusted by the rotation of one pin about its own axis.

U.S. Pat. No. 4,826,228 (Dinitz et al.) discloses a lifting device having four cables adjustable in length employed as lifting members.

SUMMARY OF THE INVENTION

An adjustable sling apparatus is provided wherein a strap having an anchor end and a free end can be adjusted in length to accommodate various loads. In one embodiment, the sling apparatus comprises a body with a means for mounting a stationary rod to the body wherein an opening is created between the rod and the body. A locking pin is rotatably mounted about the stationary rod. Means are also provided for retaining the locking pin in either a first position or a second position. In the first position, the free end of the strap is threaded through the opening, wrapped around the locking pin and threaded back through the opening. In the second position, a portion of the strap wrapped around the locking pin contacts another portion of the strap. Means are also provided for attaching the anchor end of the strap to the sling apparatus. The strap is adjustable in length when the locking pin is in the first position. When the locking pin is rotated to the second position, the strap length is fixed in its adjusted position.

In an alternate embodiment, the sling apparatus comprises a body with a first and second rod mounted in parallel to each other on the body. The first and second rods are fixedly mounted to allow the free end of the strap to be looped around the first rod. The strap is then adjusted to a desired length and then it is fixed in length by wrapping the strap over the second rod. Means are also provided to attach the anchor end of the strap to the sling apparatus.

In a further alternate embodiment, the sling apparatus comprises a clamp configurable in one of a locked position and a release position. The strap has an anchor end and a free end and is adjustable in length to accommodate various loads when the clamp is in the release position. The strap is fixed in length when the clamp is in the locked position. Also provided are means for attaching the anchor end of the strap to the sling apparatus. The clamp is pivotal when the sling apparatus is accommodating a load so that the strain on the clamp is minimized. Specifically, the clamp is pivoted so that the means for attaching the anchor end and the clamp means are positioned at equal angles with respect to an imaginary line drawn normal to a plane parallel to ground.

An object of the present invention is to provide an adjustable sling apparatus which is simple to use and cost efficient since it eliminates the need to buy various dedicated length straps.

Another object of the present invention is to provided an adjustable sling apparatus that has a simple locking mechanism to keep the sling securely locked without the use of cumbersome locking mechanisms.

A further object of the present invention is to provide an adjustable sling apparatus that has a locking mechanism requiring no moving parts thus reducing the wear factor on the sling apparatus.

A still further object of the present invention is to provide an adjustable sling apparatus that has a pivoting clamp to reduce the strain of the load on the clamp.

Other objects and advantages will become more apparent from the following detailed description.

BRIEF DESCRIPTION OF THE DRAWINGS

Further objects and advantages of this invention will become more apparent and readily appreciated from the following detailed description of the present invention, taken in conjunction with the accompanying drawings of which.

DETAILED DESCRIPTION OF THE PRESENTLY PREFERRED EMBODIMENTS

The preferred embodiments of the present invention will hereinafter be described in detail with reference to the accompanying drawings.

Figure 1:
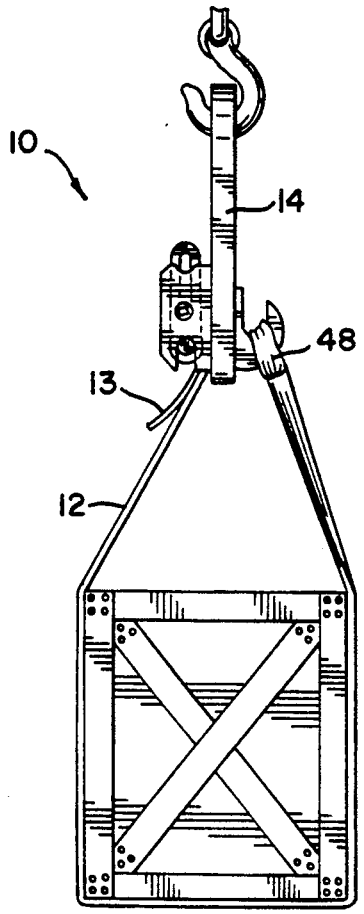
FIG. 1 is a side view of a preferred embodiment of the sling apparatus used in conjunction with a load according to a preferred embodiment of the present invention.

FIG. 1 is a side view of a preferred embodiment of the present invention. Because of its adjustability, the sling apparatus 10 can be used to carry loads of various size and weight such as crates or steel rods. Specifically, the length of the strap 12 is adjusted to accommodate the size and shape of a particular load. As shown in FIG. 1, the sling apparatus is attached to the end of a hook. The present invention can be used in conjunction with a crane, for example, and many other types of lifting or transporting devices.

Figure 2:
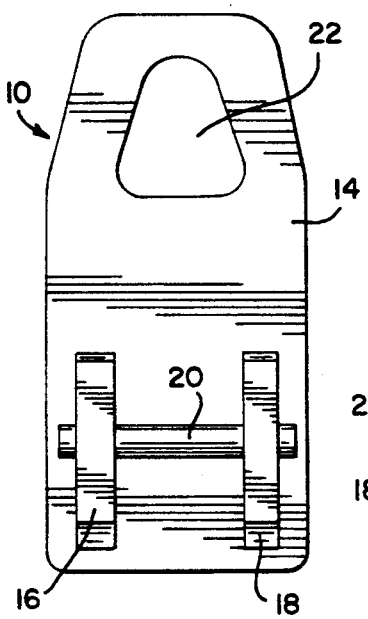
FIG. 2 is a view of struts mounted on a base body in accordance with a preferred embodiment of the present invention.

The sling apparatus will be described with reference to FIGS. 2–8. FIG. 2 is a view of struts mounted on a base body of the sling apparatus. The sling apparatus has a body 14 preferably formed of metal such as a heat treated alloy steel. Mounted on the body 14 is a first strut 16 and a second strut 18. The first and second struts, 16 and 18, are welded to the body 14. They may, however, be molded as an integral extension of the body 14 as will be described with reference to FIGS. 15 and 16. The first and second struts, 16 and 18, are separated by a distance determined by the width of the strap 12 to be used in conjunction with the sling apparatus 10. A stationary rod 20 is positioned between the first and second struts. Specifically, the rod 20 passes through holes (not shown) in the first strut 16 and the second strut 18. The length of the rod 20 is chosen so that the ends of the rod 20 extend outside the first and second struts. The rod 20 is retained by the first and second struts by welding the rod 20 to the struts. Alternatively, the ends of the rod can be threaded to accommodate fasteners such as bolts (not shown). An opening 22 is provided in the top of the body 14 for attaching the sling apparatus 10 to a hook as shown in FIG. 1.

Figure 3:
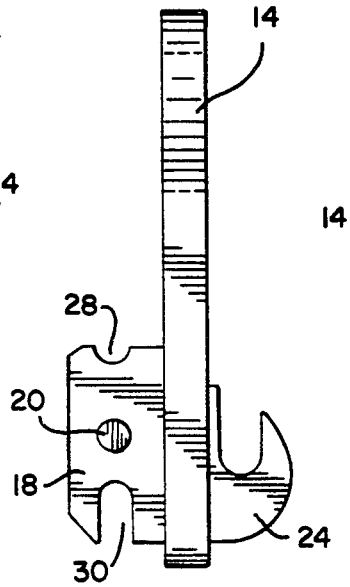
FIG. 3 is a side view of the apparatus shown in FIG. 2 illustrating a hook mounted on the base body.
Figure 15:
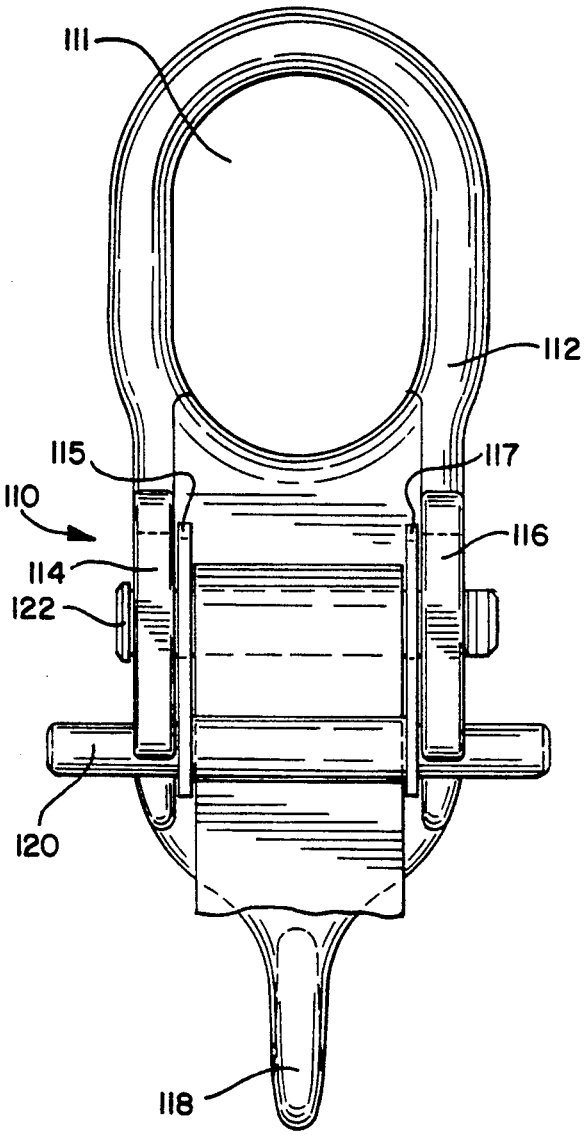
FIG. 15 illustrates a sling apparatus according to a fifth embodiment of the present invention.
Figure 16:
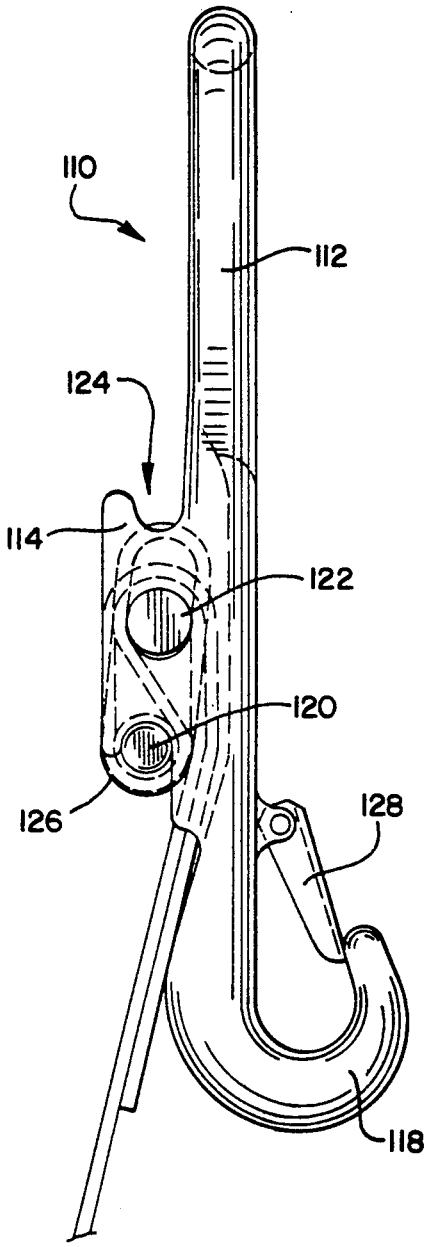
FIG. 16 is a side view of the sling apparatus shown in FIG. 15.

FIG. 3 is a side view of the sling apparatus shown in FIG. 2. Attached to the front surface of the body 14 is the second strut 18 as described above. The first and second struts, 16 and 18, will be described in greater detail with reference to FIG. 6. A hook 24 is mounted on the back surface of the body 14. The hook 24 is preferably welded to the body 14, however, it can also be formed as an integral extension of the body 14 as shown in FIGS. 15 and 16.

Figure 4:
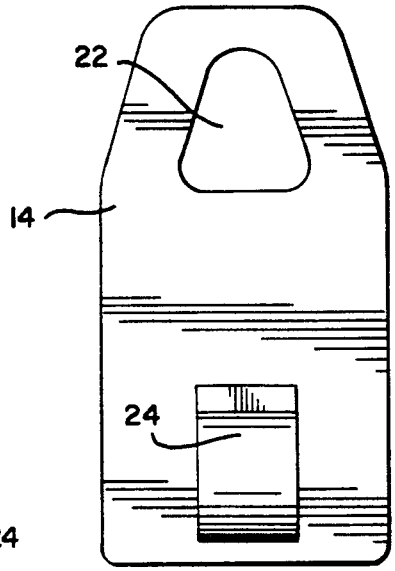
FIG. 4 is a back view of the apparatus shown in FIGS. 2 and 3.
Figure 5:
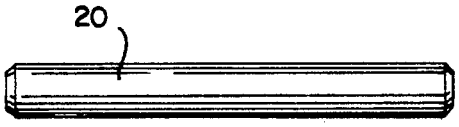
FIG. 5 is a perspective view of a stationary rod shown in FIG. 2.

FIG. 4 is a back view of the sling apparatus 10 illustrating the position of the hook 24 on the body 14. FIG. 5 is a perspective view of the stationary rod 20. The rod 20 is shown as having tapered ends, however, it is not necessary that the rod 20 have tapered ends. The ends of the rod 20 may be threaded to accommodate fasteners such as bolts.

Figure 6:
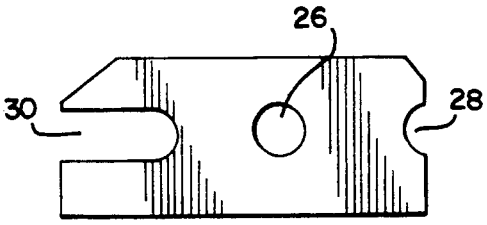
FIG. 6 is a side view of a strut shown in FIG. 2.

FIG. 6 is a side view of a strut used in the present invention. The first and second struts are preferably identical in shape thus only the first strut 16 need be described in detail. The strut 16 has an opening 26 through which the stationary rod 20 is mounted. A top recess 28 is formed at one end of the strut 16. A bottom recess 30 is formed at the opposite end of the strut 16. When the sling apparatus is in the unlocked position, a locking pin (not shown) is held in position at the top of the struts 16 and 18 by the top recesses 28. When the sling apparatus is in the locked position, the locking pin (not shown) is held in position at the bottom of the struts 16 and 18 by the bottom recesses 30. The bottom recesses 30 are shown as being deeper than the top recesses 28, however, the bottom and top recesses can be the same size as illustrated in FIGS. 15 and 16 by first recesses 124 and second recesses 126.

Figure 7:
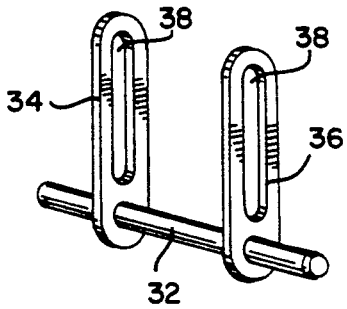
FIG. 7 illustrates a locking pin in accordance with a first embodiment of the present invention.

FIG. 7 illustrates a locking pin 32 in accordance with a first preferred embodiment of the present invention. The locking pin 32 is shown as having the same diameter as the stationary rod 20 although it is not necessary that they have the same diameter. As will be discussed later with respect to FIGS. 15–23, it is preferable that the stationary rod 20 have a larger diameter than the locking pin 32. Extending from the locking pin 32 is a first arm 34 and a second arm 36. The first and second arms, 34 and 36, are positioned on the pin 32 so that they fit between the first and second struts 16 and 18. The desirability of having the first and second arms, 34 and 36, located between the first and second struts, 16 and 18, will be described hereinafter with respect to the operation of the sling apparatus. The first and second arms, 34 and 36, are each provided with slots 38. Guided in the slots is the stationary rod 20. The slots 38 allow the first and second arms 34 and 36 and thus the locking pin 32 to be moved towards or away from the stationary rod 20.

Figure 8:
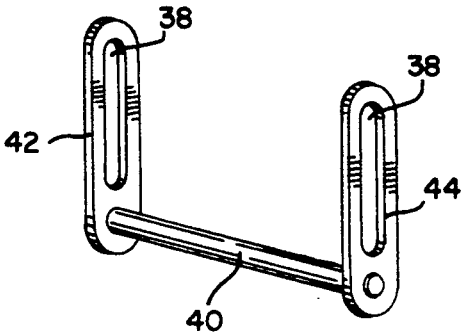
FIG. 8 illustrates a locking pin in accordance with a second embodiment of the present invention.

FIG. 8 illustrates a locking pin 40 according to a second embodiment of the present invention. A first and second arm, 42 and 44, are located at the end of the pin 40. When the locking pin 40 is attached to the stationary rod 20, the first arm 42 is located on the exterior side of the first strut 16 and the second arm 44 is located on the exterior side of the second strut 18.

Figure 9:
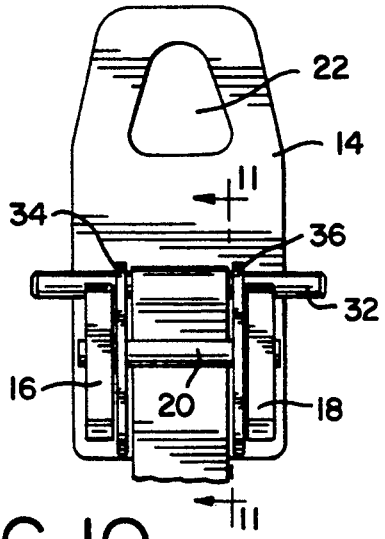
FIG. 9 illustrates a preferred embodiment of the sling apparatus assembled and positioned in an unlocked position.

FIG. 9 illustrates the sling apparatus assembled and positioned in an unlocked position in accordance with the present invention. The locking pin 32 is held in place by the top recesses (not shown) located at the top surfaces of the first and second struts 16 and 18. The first and second arms, 34 and 36, of the locking pin 32 are located between the first and second struts, 16 and 18. The operation of the apparatus will be explained with reference to FIGS. 9 and 11. A strap has an anchor end (48 shown in FIG. 1) and a free end (13 shown in FIG. 1). The anchor end 48 is shown in FIG. 1 as having a loop which can be a metal ring or it may be constructed out of the strap 12 itself. The anchor end 48 is attached to the sling apparatus 10 by the hook 24. The free end 13 of the strap 12 shown in FIG. 1 is threaded between the first and second struts, 16 and 18. The free end 13 is pulled underneath the stationary rod 20 and then wrapped around the locking pin 32. Specifically, the free end 13 is brought over locking pin 32 and around behind the pin 32 towards the body 14. The strap 12 is again threaded underneath the stationary rod 20.

The strap 12 is adjusted by pulling the free end 13 until the strap 12 is the proper length to support a particular load. Once the strap 12 has been adjusted to a proper length, the locking pin 32 is rotated to the locked position.

Figure 10:
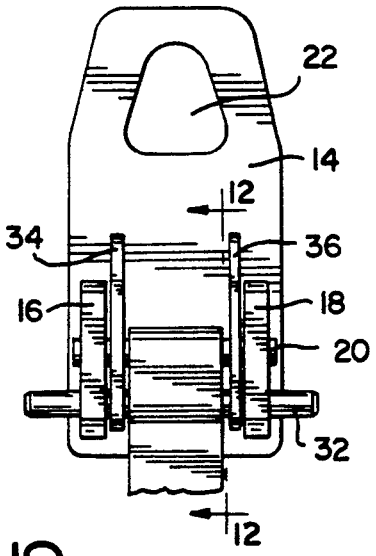
FIG. 10 illustrates a preferred embodiment of the sling apparatus assembled and positioned in a locked position.
Figure 12:
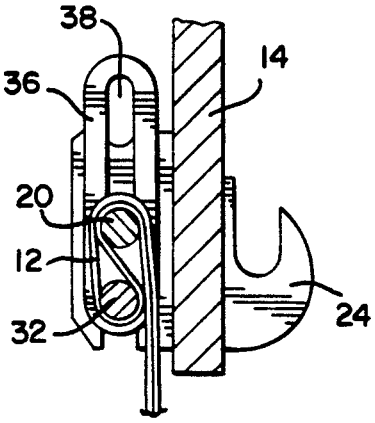
FIG. 12 is a side view of the sling apparatus in the locked position shown in FIG. 10.

FIGS. 10 and 12 illustrate the sling apparatus 10 in a locked position. The locking pin 32 is rotated about the stationary rod 20 by lifting the locking pin 32 from the top recesses 28 located in the first and second struts, 16 and 18. Once the pin 32 is free from the top recesses 28 it is rotated around the stationary rod 20 until it is positioned in line with the bottom recesses (not shown) in the first and second struts, 16 and 18. The slots 38 in the arms, 34 and 36, of the locking pin 32 allow the pin 32 to be rotated from its unlocked position to its locked position. In the locked position, the locking pin 32 is located on the opposite side of the stationary rod 20 from its unlocked position.

By rotating the pin 32 around the rod 20, the strap 12, which is wrapped around the locking pin 32, is brought in contact with a portion of the strap 12. When tension is applied to the strap 12, friction is created between the contacting portions of the strap 12. In addition, when tension is applied to the strap 12, the locking pin 32 slides in the bottom recesses (not shown) in the first and second struts, 16 and 18, in a direction towards the stationary rod 20 thereby bringing the locking pin 32 closer to the stationary rod 20. The bottom recesses (not shown) prevent the locking pin 32 from becoming inadvertently unlocked.

Positioning the first and second arms 34 and 36 between the first and second struts, 16 and 18, in accordance with the first embodiment shown in FIG. 7, prevents the strap 12 from entering the bottom recesses 30 and become pinched therein. Positioning the arms, 34 and 36, outside the first and second struts, 16 and 18, in accordance with the second embodiment shown in FIG. 8, the strap 12 may become pinched in the bottom recesses 30 when the locking pin 32 is rotated to the locked position.

Figure 11:
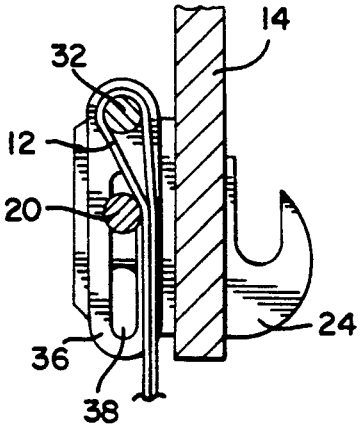
FIG. 11 is a side view of the sling apparatus in the unlocked position shown in FIG. 9.

To unlock the sling apparatus 10, the locking pin 32 is pulled away from the stationary rod 20 by sliding the pin 32 out of the bottom recesses 30. Once the pin 32 is free from the bottom recesses 30, it is rotated to the top of the struts 16 and 18, and held in place by the top recesses 28 as shown in FIGS. 9 and 11.

Figure 13:
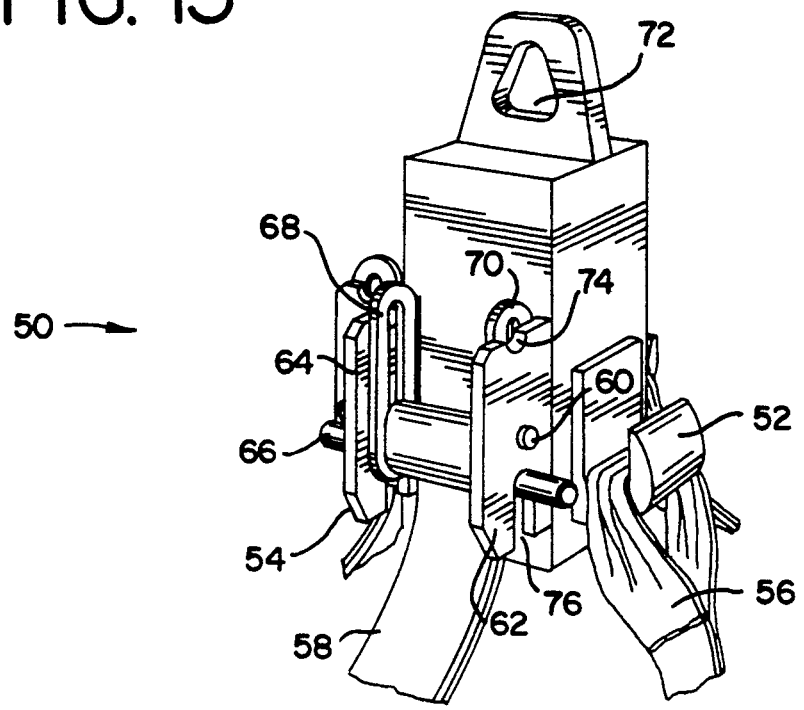
FIG. 13 illustrates a third embodiment of the present invention comprising a double sling apparatus.

FIG. 13 illustrates a third embodiment of the present invention comprising a double sling apparatus 50. The opening 72 is provided for attaching the sling apparatus 50 to a hook as shown in FIG. 1. The sling apparatus 50 has a first hook 52 and a second hook (not shown), a first clamping head 54 and a second clamping head (not shown). The sling apparatus 50 uses a first strap 56 and a second strap 58. The first strap 56 has one end which attaches to the first hook 52 and an opposite end adjusted and locked into position by the second clamping head (not shown). The second strap 58 has one end which attaches to the second hook (not shown) and an opposite end adjusted and locked into position by the first clamping head 54. Alternately, the first strap 56 may be attached so that one end of the strap 56 attaches to the first hook 52 and an opposite end is adjusted and locked into position by the first clamping head 54. The second strap 58 can be attached so that one end of the strap 52 is attached to the second hook (not shown) and the opposite end of the strap 52 is adjusted and locked into position by the second clamping head (not shown). The sling apparatus 50 is useful for loads that require support on four sides as opposed to two sides as shown in FIG. 1. The operation of each of the first and second clamping heads is identical to the sling apparatus 10 described above. For example, the first clamping head 54 includes a first strut 62, a second strut 64, a stationary pin 60, a locking pin 66 having a first arm 68 and a second arm 70 and first recesses 74 and second recesses 76 located in the first and second struts 62 and 64. Therefore, no further description need be given.

Figure 14:
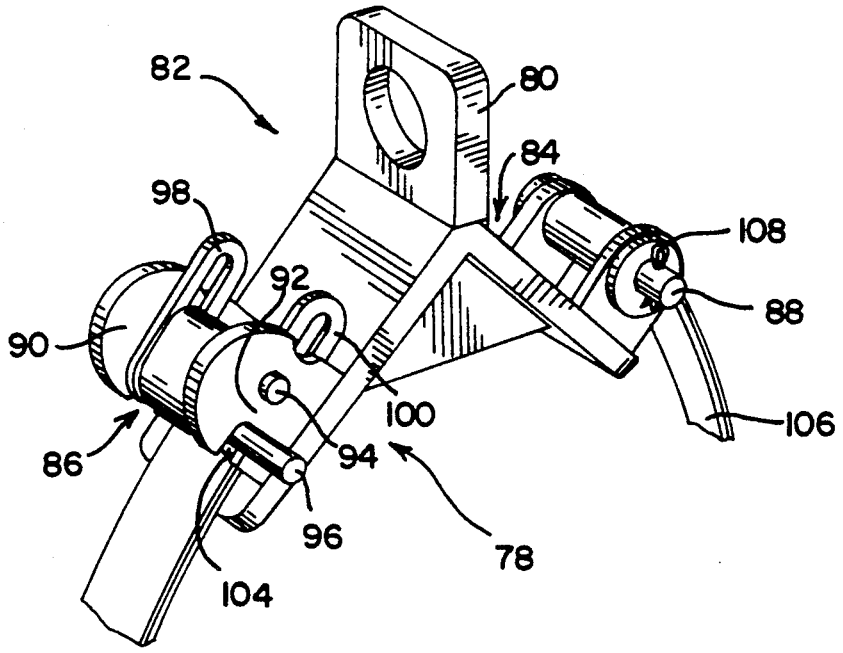
FIG. 14 illustrates a sling apparatus in accordance with a fourth embodiment of the present invention.

FIG. 14 illustrates a sling apparatus 78 in accordance with a fourth embodiment of the present invention. A body 80 having a first leg 82 and a second leg 84 has a clamping head 86 located on the first leg 82 and an attachment bar 88 on the second leg 84. The clamping head 86 is nearly identical to that shown in FIG. 1 including a first strut 90, a second strut 92, a stationary pin 94, a locking pin 96 having a first arm 98 and a second arm 100 and first recesses 102 and second recesses 104 located in the first and second struts 90 and 92. Therefore no further description need be given with respect to the clamping head 86. The attachment bar 88 connects one end of the strap 106 to the sling apparatus 78 by wrapping it around the bar 88 and attaching the free end of the strap onto the strap 106. A locking pin 108 on each side of the bar 88 holds the bar in place. In order to remove the strap 106, the locking pins 108 must be removed from the bar 88. After the pins 108 have been removed, the bar 88 slides out and the strap 106 is removed.

FIG. 15 illustrates a sling apparatus according to a fifth embodiment. The sling apparatus 110 has a body 112 having a first and second strut 114 and 116 molded as an integral extension of the body 112. An opening 111 is provided in the body 112 for attaching the sling apparatus 110 to a hook as shown in FIG. 1. In addition a hook 118 is formed as an integral extension of the body 112. A locking pin 120 having a first arm 115 and a second arm 117 is rotatably mounted about a stationary pin 122.

FIG. 16 is a side view of the sling apparatus shown in FIG. 15. The first strut 114 and second strut (not shown) have formed therein first recesses 124 and second recesses (not shown). The hook 118 has a locking means 128.

The operation of the sling apparatus 110 is the same as the operation of the sling apparatus 10 in FIGS. 9-12 described above and thus need not be repeated. Several variations have been provided, however. The second recesses 126 are approximately the same size as the first recesses 124 and the hook 118 is provided with a locking means 128 to prevent the strap from being inadvertently removed from the hook 118.

Figure 17:
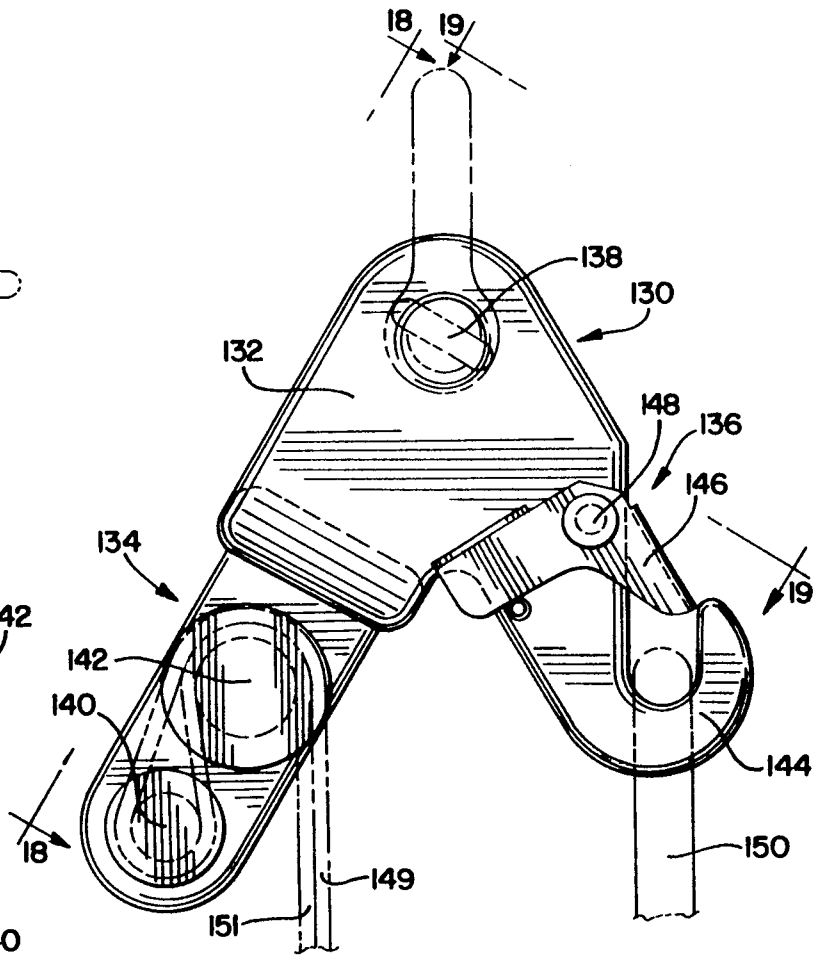
FIG. 17 illustrates a sixth embodiment of the present invention.

FIG. 17 illustrates a sixth embodiment of the present invention. The sling apparatus 130 has a body 132 preferably constructed of forged metal. The body 132 is V-shaped having a first leg 134 and a second leg 136. An opening 138 is provided in the top of the body 132 for attaching the sling apparatus 130 to a connector such as a shackle (shown in phantom). Mounted on the first leg 134 of the body 132 is a first rod 140 and a second rod 142. The first rod 140 and second rod 142 are welded to the body 132. They may, however, be molded as an integral extension of the body 132. The first and second rods 140 and 142 are substantially parallel to one another and separated by a distance as will be described in greater detail with respect to the operation of the sling apparatus.

The second leg 136 of the sling apparatus 130 ends in a hook 144 with a locking means 146. The locking means 146 is attached to the body 132 by means of a pivot pin 148.

Figure 18:
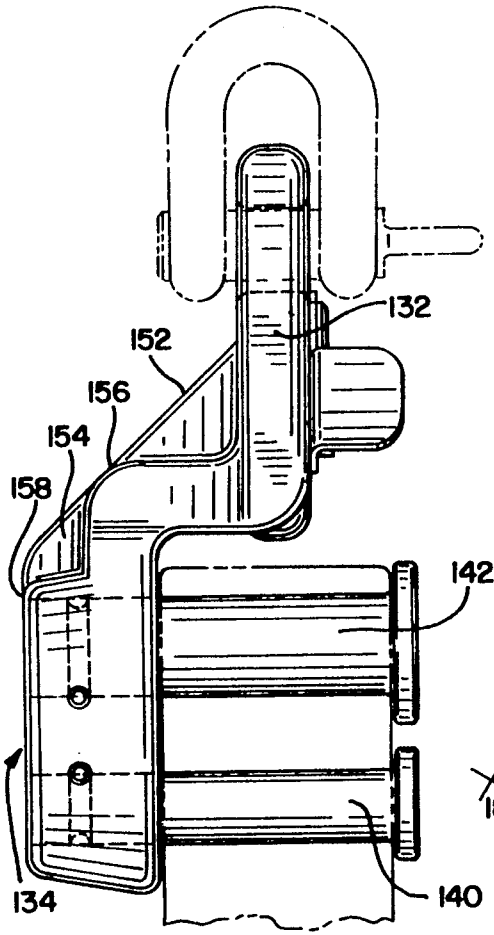
FIG. 18 is a first side view of the sling apparatus shown in FIG. 17.

FIG. 18 is a side view of the sling apparatus 130 illustrated in FIG. 17. The first rod 140 and the second rod 142 extend substantially perpendicular to the body 132 and parallel to one another. The second rod 142 preferably has a larger diameter than the first rod 140 although the diameters can be equivalent. Tests conducted on the sling apparatus show that approximately 75% of the load is concentrated on the second rod 142, or in the previous embodiments, the stationary rods 20 of FIGS. 1-12, 60 of FIG. 13, 94 of FIG. 14 and 122 of FIGS. 15-16. The first rod 140, or the locking pins 32 or 40 of FIGS. 1-12, 66 of FIG. 13, 96 of FIG. 14 and 120 of FIGS. 15-16 in the previous embodiments, act as an anchor and thus do not have the same percentage of load applied to it. The forces transmitted by the sling strap 149 appear to be focused 180° from the line of pull.

Figure 19:
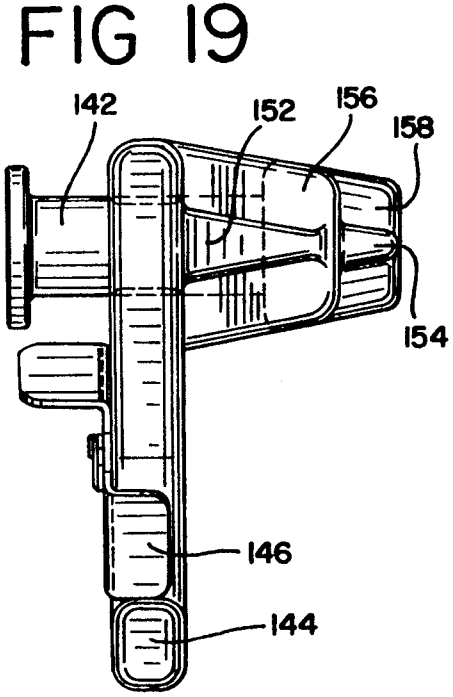
FIG. 19 is a second side view of the sling apparatus shown in FIG. 17.

The preferred embodiment therefore requires the diameters of the second rod 142 shown in FIGS. 17-19 and the stationary rods 20 of FIGS. 1-12, 60 of FIG. 13, 94 of FIG. 14 and 122 of FIGS. 15-16 to be greater than the diameters of the first rod 140 or the locking pins 32 or 40 of FIGS. 1-12, 66 of FIG. 13, 96 of FIG. 14 and 120 of FIGS. 15-16 respectfully. The sling apparatus including the rods and pins are designed to share the forces exerted on them with a ten time minimum safety factor. The first leg 134 of the body 132 is shaped so that the first and second rods 140 and 142 are underneath part of the body 132, thus centering the load placed on the sling apparatus 130. The first leg 134 of the body 132 has a first and second gusset 156 and 158 and a first and second plane 152 and 154.

FIG. 19 is a side view of the sling apparatus shown in FIG. 17. The first and second planes 152 and 154 and the first and second gussets 156 and 158 are illustrated along with first and second rods 140 and 142. In addition, hook 144 and locking means 146 are shown.

The operation of the sling apparatus 130 will now be described. The sling apparatus 130 shown in the embodiments of FIGS. 17-19 differs from those shown in FIGS. 1-16 in that the locking mechanism requires no moving parts. Specifically, the rods 140 and 142 are not required to rotate about their own axes or about each other. Apart from the pivotal locking means 146, there are no moving parts in the sling apparatus 130. As mentioned above, the strap 149 has a free end 151 and an anchor end 150. The anchor end 150 of the strap 149 is shown in FIG. 17 as having a loop 150 which can be a metal ring to which the strap 149 is attached or it may be constructed out of the strap 149 itself. Thus the anchor end 150 of the strap 149 is attached to the sling apparatus 130 by the hook 144. The locking means 146 allows the anchor end 150 to be placed in the hook 144 but prevents the anchor end 150 from inadvertently being removed from the hook.

The free end 151 of the strap 149 is first looped around the first rod 140. The strap 149 can then be adjusted in length by pulling the free end 151 until the strap 149 is the proper length to support a particular load. Once the strap 149 has been adjusted to a proper length, the free end 151 of the strap 149 located on one side of the first rod 140 and the portion of the strap 149 located on the other side of the first rod 140 are brought in contact so that the strap 149 which is now doubled on itself is wrapped over the second rod 142 as shown in FIG. 17. When tension is applied to the strap 149, friction is created between the contacting portions of the strap 149 wrapped over the second rod 142. This friction prevents the strap 149 from moving and thus fixes the strap 149 at the adjusted length.

This sixth embodiment provides advantages because there are no moving parts to break or wear down apart from the locking means 146. In addition, the sling apparatus 130 is less complicated to use.

Figure 22:
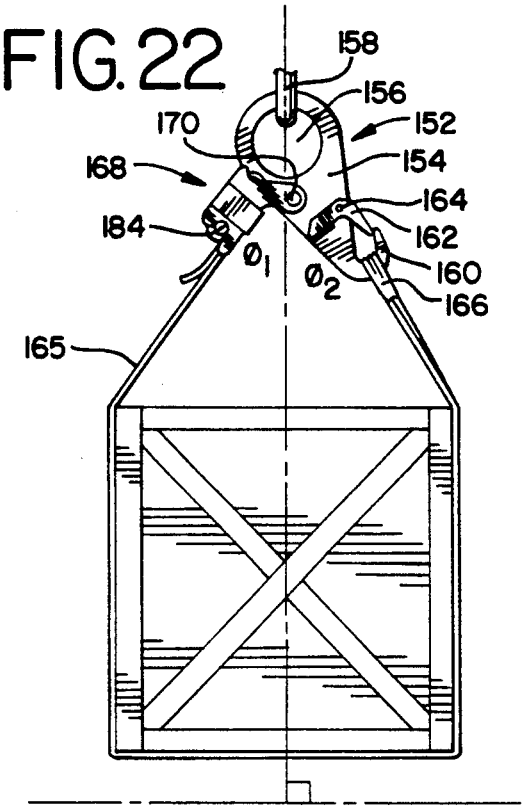
FIG. 22 is a side view of the sling apparatus shown in FIG. 20 used in conjunction with a wide load.
Figure 23:
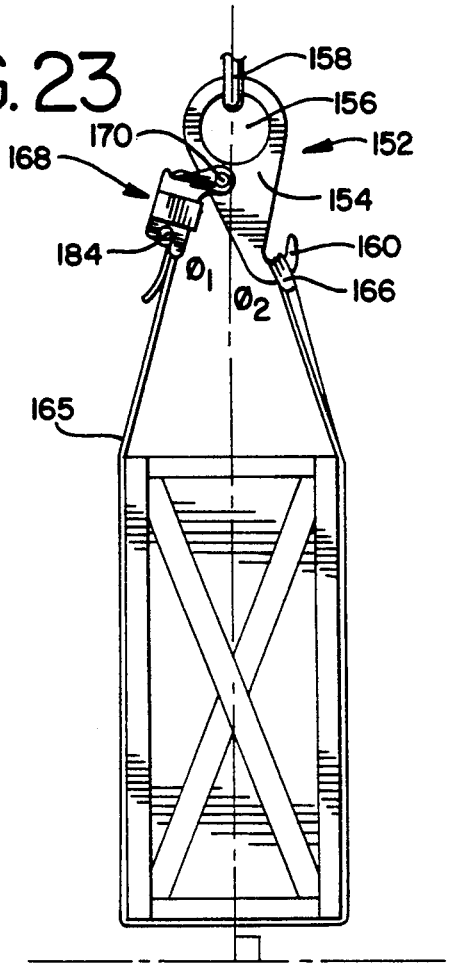
FIG. 23 is a side view of the sling apparatus shown in FIG. 20 used in conjunction with a narrow load.
Figure 20:
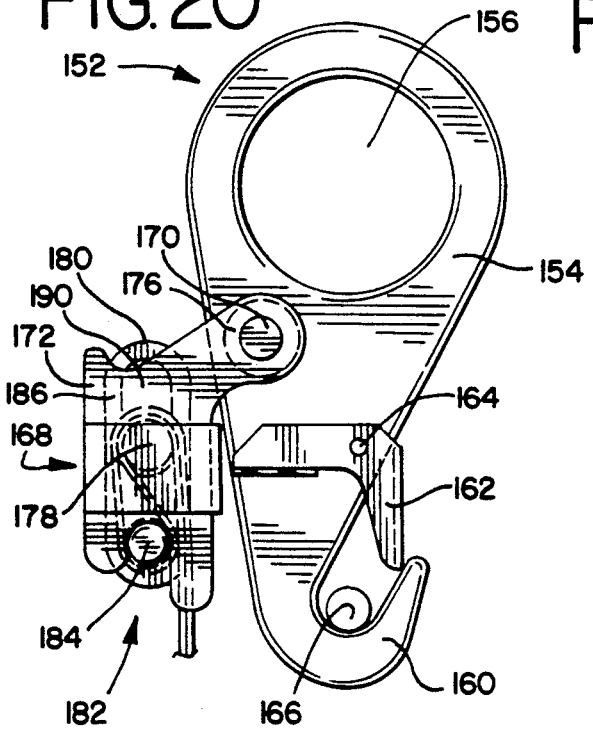
FIG. 20 illustrates a pivotal sling apparatus in accordance with a seventh embodiment of the present invention.

FIG. 20 illustrates a sling apparatus 152 according to a seventh embodiment of the present invention. The sling apparatus 152 is formed by a body 154 having a hole 156 so that the sling apparatus 152 can be attached to the end of a crane hook (shown as 158 in FIGS. 22 and 23), for example. A hook 160 is formed as an integral extension at one end of the body 154 of the sling apparatus 152. The sling apparatus 152 is preferably constructed of heat treated alloy steel. Associated with the hook 160 is a locking means 162 attached to the body 154 by means of a pivot pin 164. As shown in FIGS. 22 and 23 a strap 165 is secured to the hook 160 at the anchor end 166 of the strap 165. Once the anchor end 166 is attached to the hook 160, the locking means 162 prevents the inadvertent release of the anchor end 166 of the strap 165 from the hook 160. To remove the anchor end 166 from the hook 160, the locking means 162 are rotated about the pivot pin 164 axis. The locking means 162 is familiar to those skilled in the art.

Figure 21:
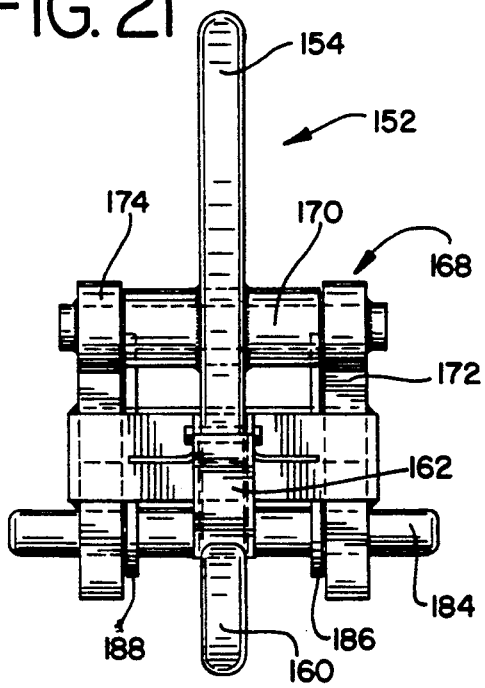
FIG. 21 is a side view of the sling apparatus shown in FIG. 20.

A pivotal clamp 168 is attached to the body 154 of the sling apparatus 152 by pin 170 so as to be rotatable about pin 170. The conditions under which the clamp 168 will rotate will be discussed later with respect to FIGS. 22 and 23. As shown in FIGS. 20 and 21 the clamp 168 comprises a first strut 172 and a second strut 174. The first and second struts 172 and 174 attach the clamp 168 to the body 154 by holes 176 provided at one end thereof so that pin 170 passes through the hole 176. A stationary rod 178 is provided between the first and second struts 172 and 174 in a manner similar to that described with respect to FIGS. 2 and 6 and thus need not be described in detail here. Specifically, the first and second struts 172 and 174 are each provided with an opening (not shown) through which the stationary rod 178 is mounted.

A top recess 180 is formed at one end of each strut. A bottom recess 182 is also formed at the opposite end of each strut. The bottom recesses 182 are shown as being deeper than the top recesses 180, however, the bottom and top recesses 180 and 182 can be the same size. A locking pin 184 is rotatably mounted about the stationary rod 178. The locking pin 184 preferably has a smaller diameter than the stationary rod 178. Extending from the locking pin 184 is a first arm 186 and a second arm (188 shown in FIG. 21). The first and the second arms 186 and 188 are each provided with slots 190. Guided in the slots 190 is the stationary rod 178. The slots 190 allow the first and second arms 186 and 188 and thus the locking pin 184 to be moved towards or away from the stationary rod 178. The first and second arms 186 and 188 are positioned on the locking pin 184 so that they fit between the first and second struts 172 and 174 of the clamp 168 (FIG. 21). By placing the first and second arms 186 and 188 between the first and second struts 172 and 174 the strap 165 is prevented from becoming caught in either the top or bottom recesses 180 and 182.

The operation of the sling apparatus 152 is the same as discussed with respect to FIGS. 1–16. The locking pin 184 rotates about the stationary rod 178 so that the locking pin 184 can be placed in one of either a locked position or a release position. When the sling apparatus 152 is in the release position, the locking pin 184 is held in position at the top of the struts 172 and 174 by the top recesses 180. When the sling apparatus 152 is in the locked position, the locking pin 184 is held in position at the bottom of the struts 172 and 174 by the bottom recesses 182. FIG. 20 illustrates the clamp 168 in a locked position.

FIG. 21 is a side view of the sling apparatus 152 shown in FIG. 20. The locking pin 184 extends beyond the first and second struts 172 and 174 so that the locking pin 184 can be easily rotated from the locked position to the release position and vice versa. The pin 170 mounts the clamp 168 to the body 154 by passing the pin 170 through the first and second struts 172 and 174 and through the hole 176.

The operation of the sling apparatus 152 with a particular load will be described with respect to FIGS. 22 and 23. FIG. 22 illustrates the sling apparatus 152 used in conjunction with a wide load. FIG. 23 illustrates the sling apparatus 152 used in conjunction with a narrow load. The strap 165 is adjusted to the proper length in the same manner as described with respect to FIGS. 1–16 above and therefore need not be discussed here. Once the proper length of strap 165 has been found, the locking pin 184 is rotated to the locked position so that the strap 165 is now fixed in length. The load to be carried by the sling apparatus 152 is secured by the strap 165 as shown in FIGS. 22 and 23.

Depending upon the size of the load, the clamp 168 will rotate a certain angle. The clamp 168 rotates in either a clockwise or counterclockwise manner so that the angle $\phi_1$ between an imaginary line drawn perpendicular with the plane of the ground and the clamp 168 is equal to the angle $\phi_2$ between the imaginary line and the hook 160. In other words, the angle between the hook 160 and the clamp 168 can be bisected into equal angles by an imaginary line drawn perpendicular to the plane of the ground. It can be seen in FIG. 22 that a wide load requires the clamp 168 to rotate a greater degree so that a larger angle is formed between the hook 160 and the clamp 168. A narrow load requires a smaller degree of rotation as shown in FIG. 23.

The pivotal clamp 168 provides the advantage of reducing the amount of stress on the stationary rod 178. As discussed above, it has been determined that the stationary rod 178 absorbs the brunt of the force of the load. In order to accommodate the stress, the stationary rod 178 has a larger diameter than the locking pin 184. In addition, it has been discovered that if the clamp 168 is allowed to rotate so that the direction of pull of the strap 165 is parallel with an axis drawn parallel to the diameters of the stationary rod 178 and locking pin 184, the stress will be reduced on the stationary rod 178. It can be seen from FIGS. 22 and 23 that the strap 165 pulls on the clamp 168 in a direction parallel to an axis drawn parallel to the diameters of the two rods. Thus in FIG. 22 a wide load causes the strap 165 to pull at a angle $\phi_1$ from the imaginary line drawn perpendicular to the plane of the ground. The clamp 168 therefore rotates the same angle $\phi_1$ away from the imaginary line. In FIG. 23 the load is narrower so the strap 165 pulls at a smaller angle $\phi_2$ from the imaginary line. The clamp 168 rotates the same smaller angle so that it is parallel with the direction of pull.

The sling apparatuses illustrated in FIGS. 1–23 can be made in various sizes to accommodate various load capacities and various rated straps. Although the sling apparatuses described above have been designed with a ten time minimum safety factor using heat treated alloy steel various others metals may be used depending on the conditions under which the sling apparatus will be operated.

While this invention has been shown and described in connection with preferred embodiments, it is apparent that certain changes and modifications, in addition to those mentioned above, may be made from the basic features of the present invention. Accordingly, it is the intention of the Applicant to protect all variations and modifications within the true spirit and valid scope of the present invention.

What is claimed is:

1. An adjustable sling apparatus including a strap having an anchor end and a free end including:

a body;

means for mounting a stationary rod to said body such that an opening is created between said rod and said body;

a locking pin pivotally connected to said stationary rod wherein said locking pin is rotatable about said stationary rod;

means for retaining said locking pin in one of a first position and a second position, the free end of the strap being threaded through said opening, wrapped around said locking pin and threaded back through said opening when said locking pin is in the first position, and a portion of the strap being wrapped around said locking pin contacting another portion of the strap when said locking pin is in the second position; and means for attaching the anchor end of the strap to the sling apparatus wherein the strap is adjustable in length to accommodate various loads when said locking pin is in the first position and the strap is fixed in length when said locking pin is rotated to the second position.

2. A sling apparatus according to claim 1 wherein said means for mounting said stationary rod to said body comprises a first strut and a second strut on said body, wherein said first strut is parallel to and separated from said second strut by a distance at least equal to the width of the strap wherein said stationary rod is mounted across said first and second struts.

3. A sling apparatus according to claim 1 wherein said means for attaching the anchor end of the strap to the sling apparatus comprises a hook.

4. A sling apparatus according to claim 2 wherein said means for retaining said locking pin in a first position comprises a first recess formed in said first and second struts and said means for retaining said locking pin in a second position comprises a second recess formed in said first and second struts.

5. A sling apparatus according to claim 2 wherein said locking pin has a first and a second arm wherein said first and second arms attach said pin to said stationary rod.

6. A sling apparatus according to claim 5 wherein said first and second arms of said pin are connected to said rod at a first and second point respectively located between said first and second struts.

7. A sling apparatus according to claim 1 further comprising:

second means for mounting a second stationary rod to said body such that an opening is created between said rod and body;

a second locking pin rotatably mounted about said second stationary rod;

means for retaining said second locking pin in one of a first position and a second position, the free end of the second strap being threaded through said opening, wrapped around said second locking pin and threaded back through said opening when said second locking pin is in the first position, and a portion of the strap being wrapped around said locking pin contacting another portion of the strap when said second locking pin is in the second position; and second means for attaching the anchor end of the second strap to the sling apparatus wherein the second strap is independently adjustable in length when said second locking pin is in the first position and the second strap is fixed in length when said second locking pin is rotated to the second position.

8. A sling apparatus comprising:

a strap having an anchor end and a free end;

a clamp configurable in one of a locked position and a release position wherein said strap is adjustable in length to accommodate various loads when said clamp is in said release position and the strap is fixed in length when said clamp is in said locked position;

means for attaching said anchor end of said strap to said sling apparatus; and means for pivoting said clamp when said sling apparatus is accommodating a load wherein the strain on said clamp is minimized.

9. A sling apparatus comprising:

a strap having an anchor end and a free end;

a clamp configurable in one of a locked position and a release position wherein said strap is adjustable in length to accommodate various loads when said clamp is in said release position and the strap is fixed in length when said clamp is in said locked position;

means for attaching said anchor end of said strap to said sling apparatus; and means for pivoting said clamp when said sling apparatus is accommodating a load wherein said means for attaching said anchor end and said clamp means are positioned at equal angles with respect to an imaginary line drawn normal to a plane parallel to ground.

10. A sling apparatus according to claim 8 wherein said clamp comprises:

a locking pin rotatably mounted about a stationary rod; and means for retaining said locking pin in one of said locked position or said release position wherein said strap is wrapped around said locking pin and a portion of said strap wrapped around said locking pin contacts another portion of said strap when said clamp is in said locked position.

11. A sling apparatus according to claim 9 wherein said clamp comprises:

a locking pin rotatably mounted about a stationary rod; and means for retaining said locking pin in one of said locked position or said release position wherein said strap is wrapped around said locking pin and a portion of said strap wrapped around said locking pin contacts another portion of said strap when said clamp is in said locked position.

12. A sling apparatus according to claim 10 wherein said stationary rod has a greater diameter than said locking pin.

13. A sling apparatus according to claim 11 wherein said stationary rod has a greater diameter than said locking pin.

14. An adjustable sling apparatus including a strap having an anchor end and a free end including:

a body having means for attaching said anchor end of said strap;

a pivotal arm;

a first rod mounted to said pivotal arm;

a second rod rotatably mounted about said first rod; and means for retaining said second rod in one of a first position and a second position, the free end of the strap wrapped around said second rod when said second rod is in said first position and a portion of the strap being wrapped around said second rod contacting another portion of the strap when said second rod is in said second position, wherein the strap is adjustable in length to accommodate various loads when said second rod is in said first position and the strap is fixed in length when said second rod is rotated to said second position, said arm pivoting when said sling apparatus is accommodating a load thereby positioning said means for attaching said anchor end and said arm at equal angles with respect to an imaginary line drawn normal to a plane parallel to ground.

* * * * *